US008602283B2

(12) United States Patent
Tamura et al.

(10) Patent No.: US 8,602,283 B2
(45) Date of Patent: Dec. 10, 2013

(54) GAS COMBUSTION TYPE DRIVING TOOL

(75) Inventors: Junichi Tamura, Chuo-ku (JP); Katsuhiko Murayama, Chuo-ku (JP); Masakazu Konishi, Chuo-ku (JP)

(73) Assignee: Max Co., Ltd., Tokyo (JP)

( * ) Notice: Subject to any disclaimer, the term of this patent is extended or adjusted under 35 U.S.C. 154(b) by 195 days.

(21) Appl. No.: 12/666,928

(22) PCT Filed: Jul. 2, 2008

(86) PCT No.: PCT/JP2008/062011
§ 371 (c)(1),
(2), (4) Date: Dec. 28, 2009

(87) PCT Pub. No.: WO2009/005099
PCT Pub. Date: Jan. 8, 2009

(65) Prior Publication Data

US 2010/0327038 A1 Dec. 30, 2010

(30) Foreign Application Priority Data

Jul. 4, 2007 (JP) ..... P2007-176033

(51) Int. Cl.
*B25C 1/08* (2006.01)

(52) U.S. Cl.
USPC ... 227/10; 227/8; 227/9; 227/130; 123/46 SC

(58) Field of Classification Search
USPC ..... 227/2, 8, 9, 10, 130, 131; 123/46 SC, 123/46 H
See application file for complete search history.

(56) References Cited

U.S. PATENT DOCUMENTS

| | | | | | |
|---|---|---|---|---|---|
| 2,955,182 | A | * | 10/1960 | Wood et al. | 218/68 |
| 3,524,576 | A | * | 8/1970 | Bader | 227/136 |
| 3,622,062 | A | * | 11/1971 | Goode et al. | 227/130 |
| 3,945,551 | A | * | 3/1976 | Sato et al. | 227/136 |
| 4,259,097 | A | * | 3/1981 | Patel et al. | 96/136 |
| 6,041,992 | A | * | 3/2000 | Poinelli et al. | 227/130 |
| 6,244,853 | B1 | * | 6/2001 | Oglesby et al. | 431/6 |
| 7,178,831 | B2 | | 2/2007 | Yoshida et al. | |
| 2005/0130085 | A1 | * | 6/2005 | Kamijo | 431/6 |
| 2006/0029897 | A1 | * | 2/2006 | Saijo et al. | 432/121 |

FOREIGN PATENT DOCUMENTS

| | | | | |
|---|---|---|---|---|
| CN | 1612820 | A | | 5/2005 |
| JP | 4-28970 | | | 3/1992 |
| JP | 2001-10888 | | | 1/2001 |
| JP | 2004-291094 | | | 10/2004 |
| JP | 2006-76849 | A | | 3/2006 |
| JP | 2006-315102 | | | 11/2006 |
| JP | 2006315102 | A | * | 11/2006 |
| JP | 2007-15573 | | | 1/2007 |

* cited by examiner

*Primary Examiner* — Alexandra Elve
*Assistant Examiner* — Nathaniel Chukwurah
(74) *Attorney, Agent, or Firm* — Drinker Biddle & Reath LLP

(57) ABSTRACT

A gas combustion type driving tool includes a feed piston/cylinder mechanism 6 by which a feed piston 8, engaged/disengaged to/from a connecting fastener housed in a magazine, is reciprocated in a fastener feed direction in which the piston is fed toward a nose part 5 and a retracting direction opposite to the feed direction. The feed piston 8 is constantly spring-urged in the feed direction, and part of a combustion gas is supplied to a feed cylinder 7 via a gas pipe 21 provided between the combustion chamber 4 and the feed piston/cylinder mechanism 6, thereby operating the feed piston 8 in the retracting direction against a spring 20. In the gas combustion type driving tool, filters 33 for cooling a combustion gas are located in the gas pipe 21.

3 Claims, 2 Drawing Sheets

GAS COMBUSTION TYPE DRIVING TOOL

TECHNICAL FIELD

The present invention relates to a gas combustion type driving tool including: a combustion chamber in which a gas mixture obtained by stirring and mixing a combustible gas and air is explosively combusted; a nose part for driving out a fastener by a combustion gas pressure; and a feed piston/cylinder mechanism for supplying a fastener to the nose part. There is provided an improved gas pipe through which a combustion gas from the combustion chamber is supplied to the piston/cylinder mechanism to operate the mechanism.

BACKGROUND ART

A gas combustion type driving tool injects a combustible gas into a combustion chamber, hermetically sealed within a body, to stir a gas mixture of the combustible gas and air inside the combustion chamber, and combusts the stirred gas mixture inside the combustion chamber, thereby producing a high pressure combustion gas inside the combustion chamber. Further, this high pressure combustion gas acts on a hammering piston contained in a hammering cylinder, thus causing the hammering piston to be impulsively driven within the hammering cylinder. A driver connected to a lower face side of the hammering piston drives a nail, which has been supplied to a nose part located below the body, into a steel plate or concrete. By way of example, in such a combustion gas driven driving device, a container such as a gas bomb filled with a combustible gas is inserted into a tool. Furthermore, a battery serving as a power source for igniting a combustible gas is attached to the tool, thereby forming the tool as a portable tool. Therefore, an operation for driving a nail or a pin can be carried out without being restricted by a supply source of power such as electric power or compressed air.

Actually, the foregoing gas combustion type driving tool is provided with a feed mechanism for sequentially feeding, to a nose part, a connecting fastener housed in a magazine. As such a feed mechanism, there is generally used a feed piston/cylinder mechanism that has a feed piston slidably contained in a feed cylinder and provided with a feed claw engageable/disengageable to/from the connecting fastener housed in the magazine, and that reciprocates the feed piston in a nail feed direction in which the feed piston is fed toward the nose part and a retracting direction opposite to the feed direction.

In this case, as the feed piston of the feed piston/cylinder mechanism, there is known one in which the feed piston is reciprocated utilizing a spring and the pressure of a combustion gas inside the combustion chamber, the feed piston is constantly urged in the nail feed direction by the spring, and the feed piston is moved in the retracting direction against the spring by means of the pressure of the combustion gas at the time of hammering. In this technique, a gas pipe is located between the combustion chamber and the feed cylinder, and the combustion gas is sent to the feed cylinder via the gas pipe (JP-A-2006-315102).

However, since the volume of the combustion gas is significantly decreased upon cooling thereof, the pressure for holding the feed piston at a retracted position against the spring is also reduced. Further, the feed piston starts a fastener feed operation before predetermined timing, and the leading fastener inside the magazine is fed into the nose part so as to be brought into contact with and scraped against the driver, which is being returned, before the hammering piston is returned following the completion of a fastener driving operation. Hence, a problem that the hammering piston cannot be returned due to the resulting contact resistance might occur. Furthermore, there is also a possibility that a connecting material of the connecting fastener might be deformed, thus causing a feed failure.

DISCLOSURE OF THE INVENTION

One or more embodiments of the present invention provide a gas combustion type driving tool that supplies a high density combustion gas to a feed piston/cylinder mechanism serving as a fastener feed mechanism, thereby holding a feed piston at a retracted position and enabling the prevention of a return failure of a hammering piston and a feed failure of a fastener with reliability.

According to a first aspect of the present invention, a gas combustion type driving tool includes: a combustion chamber; a hammering cylinder; a hammering piston contained in the hammering cylinder; a nose part for guiding a driver connected to a lower face side of the hammering piston; a feed cylinder; a feed piston contained in the feed cylinder and having a feed claw engaged/disengaged to/from a connecting fastener contained in a magazine; and a gas pipe which is provided between the combustion chamber and the feed cylinder and through which part of a combustion gas is supplied to the feed piston, wherein the feed piston is constantly urged in a fastener feed direction by a spring, wherein upon supply of a combustion gas to the feed cylinder from the gas pipe, the feed piston is operated in a retracting direction against the spring, and wherein a combustion gas filter is provided in the gas pipe.

According to a second aspect of the present invention, in the gas combustion type driving tool, the filter is located so as to be divided into a plurality of filters inside the gas pipe.

According to a third aspect of the present invention, the gas combustion type driving tool includes an open/close valve in the gas pipe, and opens the gas pipe to the atmosphere in conjunction with an operation of a movable sleeve following the completion of driving.

Moreover, according to a fourth aspect of the present invention, the gas combustion type driving tool includes a check valve, and the filter includes: an upstream filter provided upstream of the check valve; and a downstream filter provided downstream thereof.

According to the first aspect of the present invention, the gas combustion type driving tool has a structure in which the filter for cooling a combustion gas is located in the gas pipe provided between the combustion chamber and the feed piston/cylinder mechanism. The combustion gas explosively combusted inside the combustion chamber is cooled and increased in density by the filter while being sent to the feed cylinder of the feed piston/cylinder mechanism through the gas pipe. Accordingly, even when the combustion gas is cooled after being sent to the inside of the feed cylinder, the combustion gas is supplied in a high density state, and therefore, the pressure thereof is not reduced much. Thus, the feed piston can be reliably held at a retracted position until the completion of return of the hammering piston. Hence, the scrape against the driver at the time of return of the hammering piston is eliminated, and a return failure of the hammering piston and a feed failure of the fastener can be prevented with reliability.

According to the second aspect of the present invention, the open/close valve for opening the gas pipe to the atmosphere in conjunction with an operation of the movable sleeve following the completion of driving of the fastener is provided in the gas pipe; thus, after the completion of driving of the fastener, the combustion gas, which has been automatically supplied to the feed cylinder, is discharged to the atmosphere through the open/close valve, and the feed piston can feed the fastener to the nose part by being operated by the spring. Accordingly, the operation of the feed piston can be controlled with a simple structure.

Other features and effects are apparent from the description of embodiments and appended claims.

BEST MODE FOR CARRYING OUT THE INVENTION

Figure 1:
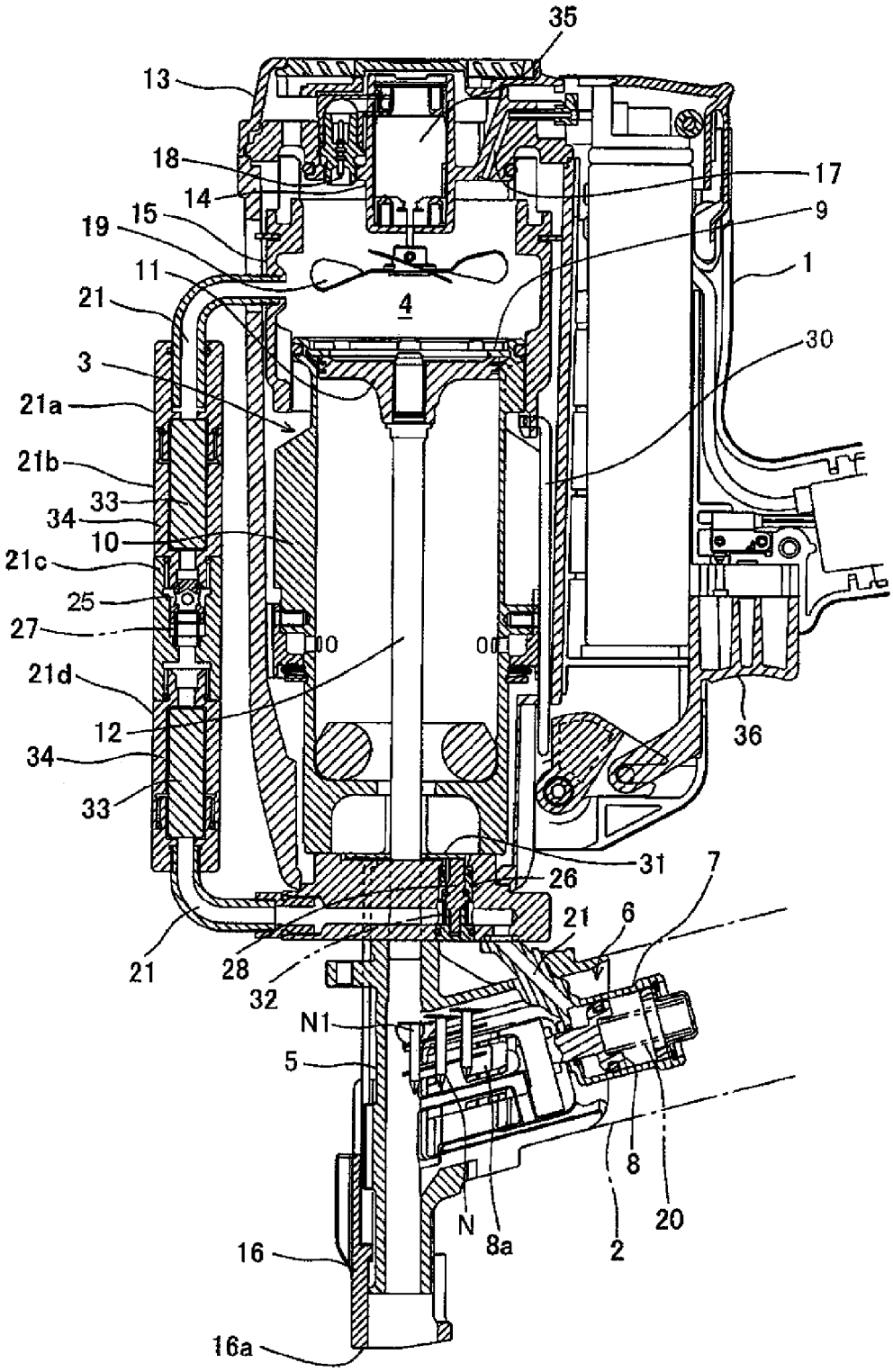
FIG. 1 A longitudinal cross-sectional view illustrating a state of a gas combustion type nail driving device during a non-operation period.

In FIG. 1, the reference numeral 1 denotes a body of a gas combustion type nail driving device. This body 1 is provided with a grip (not shown) and a magazine 2 in a continuous manner, and is further provided with a hammering piston/cylinder mechanism 3, a combustion chamber 4, a nose part 5 and a feed piston/cylinder mechanism 6 for feeding a nail.

The hammering piston/cylinder mechanism 3 contains a hammering piston 11 within a hammering cylinder 10 in a slidable manner, and is integrally connected with a driver 12 below the hammering piston 11. It should be noted that a C snap ring 9 restrains an upward movement of the hammering piston 11.

The combustion chamber 4 is formed by: an upper end face of the hammering piston 11; an upper wall 14 (cylinder head) formed inside an upper housing 13; and an annular movable sleeve 15 located between both of the foregoing elements. As shown in FIG. 1, the device is structured so that the combustion chamber 4, which is hermetically sealed, is formed by moving the movable sleeve 15 upward as shown in FIG. 2, and an upper portion of the combustion chamber 4 is communicated with the atmosphere by moving the movable sleeve 15 downward.

Figure 2:
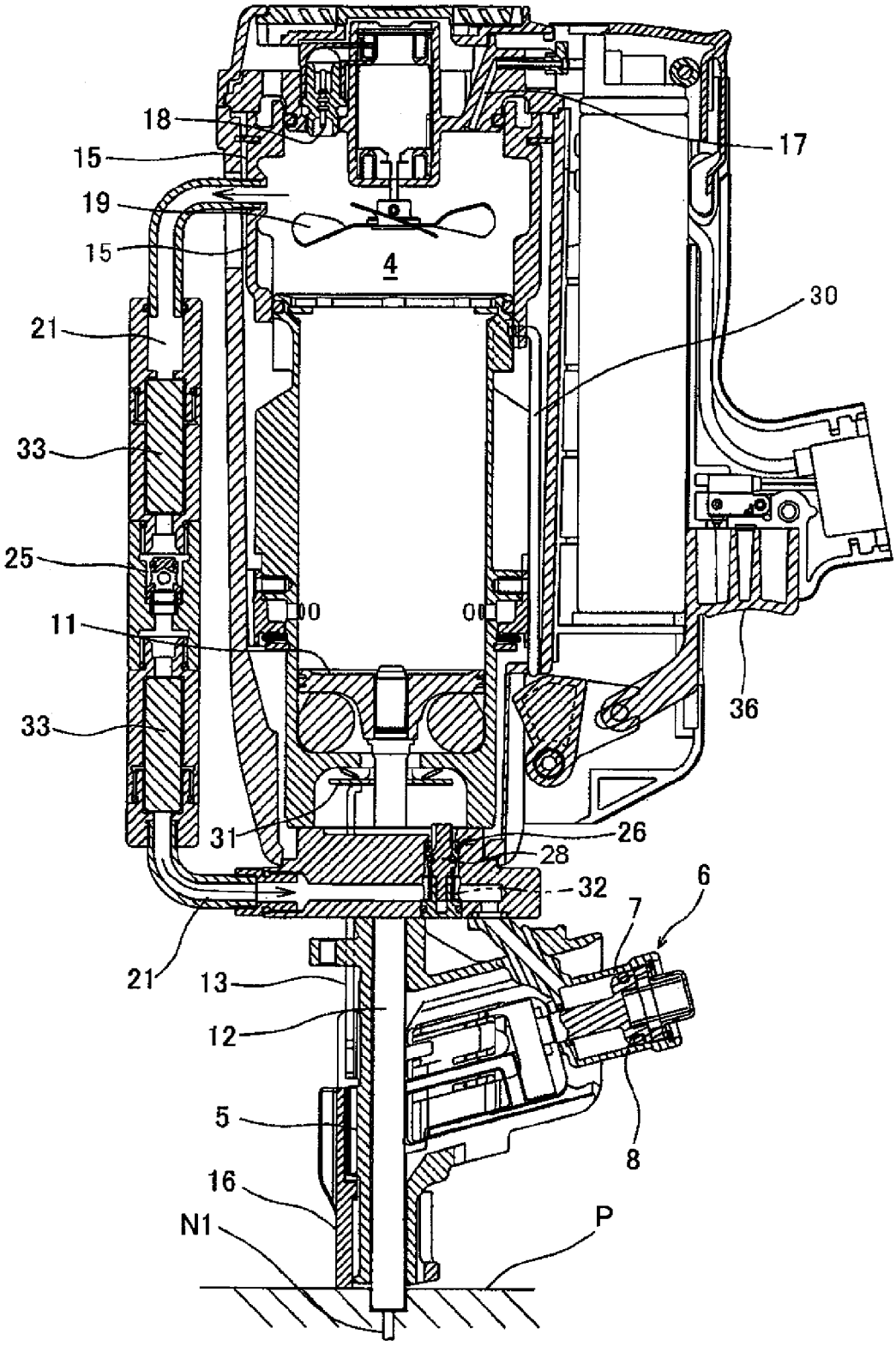
FIG. 2 A longitudinal cross-sectional view illustrating an operating aspect of the gas combustion type nail driving device.

Specifically, as shown in FIG. 2, the movable sleeve 15 is linked to a contact member 16 via a link member 30.

The contact member 16 is provided so as to be slidable upward/downward along the nose part 5, and a lower end 16*a* of the contact member 16 is protruded from the nose part 5. Further, together with the nose part 5, the lower end 16*a* is pressed against a workpiece P. In conjunction with this operation, the contact member 16 is relatively moved upward, and the movable sleeve 15 is moved upward via the link member 30. Thus, the combustion chamber 4 that is hermetically sealed (see FIG. 2) is formed. To the contrary, by separating the nose part 5 from the workpiece P, the contact member 16 is relatively moved downward, the link member 30 and the movable sleeve 15 are moved downward by a spring, and the combustion chamber 4 is opened to the atmosphere.

In the upper cylinder head 14, there are located: an injection nozzle 17 communicated with a gas container; and an ignition plug 18 for igniting and combusting a gas mixture. Furthermore, the upper cylinder head 14 is provided with a motor 35. An output shaft thereof is provided with a rotation fan 19 for stirring a combustible gas, injected into the combustion chamber 4, with air inside the combustion chamber 4, thereby producing a gas mixture with a given air-fuel ratio inside the combustion chamber 4.

The nose part 5 guides a sliding movement of the driver 12, and is opened to the magazine 2.

The feed piston/cylinder mechanism 6 contains a feed piston 8 within a feed cylinder 7 in a slidable manner, and allows a feed claw 8*a* at the tip of the feed piston 8 to be engaged/disengaged to/from a connecting nail N housed in the magazine 2. Further, the feed piston 8 is reciprocated in a nail feed direction in which the feed piston is fed toward the nose part 5 and a retracting direction opposite to the feed direction. When the feed piston 8 has been moved to its moving end in the feed direction, a leading nail N1 of the connecting nails is pushed into an ejection hole (not shown) of the nose part 5. Accordingly, with the feed piston 8 located at the moving end position in the feed direction, the connecting nail. N1 also does not move, and therefore, the leading nail is held in a state in which it is pressed against an inner wall of the ejection hole.

Next, the feed cylinder 7 of the feed piston/cylinder mechanism 6 is provided with a spring 20 for constantly urging the feed piston 8 in the feed direction. On the other hand, a part of the feed cylinder 7, opposite to the spring 20, is connected to the combustion chamber 4 via a gas pipe 21.

Moreover, a check valve 25 is provided in the gas pipe 21, and an open/close valve 26 is provided between the check valve 25 and the feed cylinder 7 of the feed piston/cylinder mechanism. The check valve 25 is urged in a close direction by a spring 27. The open/close valve 26 is operated in conjunction with an operation of the link member 30, and a valve stem 28 of the open/close valve 26 is constantly pressed by a plate-like part 31 at an intermediate position of the link member 30 so as to be located at a position at which the gas pipe 21 is opened to the atmosphere as shown in FIG. 1. At the time of driving, upon relative upward movement of the contact member 16 with respect to the nail driving device by pressing of the tip of the nose part 5 against the workpiece P as shown in FIG. 2, the plate-like part 31 is pushed up against a spring and moved upward. In response to this movement, the valve stem 28 is moved by a spring 32 to a position at which the communication between the gas pipe 21 and the atmosphere is shut off.

Next, a filter 33 for cooling a combustion gas is located at each of the upstream side and downstream side of the check valve 25 of the gas pipe 21. This filter 33 is made of a porous material, but may be made of a metal mesh material or a synthetic resin mesh material such as nylon as long as a combustion gas is brought into contact with air and rapidly cooled therethrough.

It should be noted that the inner diameters of housing parts 34 for the filters 33 are large so as to increase the cooling efficiency achieved by the filters 33 (upstream filter 33 and downstream filter 33). Moreover, the housing parts 34 for the filters 33 are structured so as to be formed by fitting concave and convex portions of two pipe members 21*a* and 21*b* and another two pipe members 21*c* and 21*d* to each other.

Next, an operating aspect of the foregoing gas combustion type nail driving device will be described. First, at the time of driving of a nail, the nose part 5 is strongly pressed against the workpiece P, and the contact member 16 is relatively moved upward as shown in FIG. 2, thereby moving the movable sleeve 15 upward to form the combustion chamber 4 that is hermetically sealed; in addition, a combustible gas is injected into the combustion chamber 4 from the injection nozzle 17, and the rotation fan 19 is rotated to stir and mix the combustible gas and air. Further, the open/close valve 26 shuts off the gas pipe 21 from the atmosphere by the upward movement of the contact member 16. Subsequently, upon pulling of a trigger 36, the ignition plug 18 ignites the gas mixture, and the gas mixture is combusted and explosively expanded. The resulting combustion gas pressure acts on an upper face of the hammering piston 11 to drive the piston downward, and therefore, the driver 12 hammers the leading nail N1 supplied into the ejection hole of the nose part 5, thus driving the nail into the workpiece P.

Simultaneously with the above-described driving operation, part of the combustion gas inside the combustion chamber 4 is supplied into the feed cylinder 7 of the feed piston/cylinder mechanism 6 through the gas pipe 21, and acts on an upper face of the feed piston 8; thus, the feed piston 8 is also moved in the retracting direction. Backflow of the combustion gas supplied into the feed cylinder 7 is inhibited by the check valve 25, and the feed piston 8 is held at the retracted position. Furthermore, the open/close valve 26 is in a closed state against the atmosphere.

Actually, part of the combustion gas inside the combustion chamber 4 is brought into contact with the filters 33 while being supplied to the feed piston/cylinder mechanism 6 through the gas pipe 21 in this manner, and is therefore cooled, resulting in an increase in density of the combustion gas. Accordingly, even when cooled after being sent to the inside of the feed cylinder 7, the combustion gas is supplied in a high density state, and thus the pressure of the combustion gas is not reduced much even when it is cooled. Therefore, the feed piston 8 can be held at the retracted position.

Since the temperature of inside of the combustion chamber 4 sharply decreases upon completion of the driving, the pressure of a space above the hammering piston 11, which is enlarged to the hammering cylinder 10, becomes a negative pressure. Further, since the hammering piston 11 tries to return to its original volume due to a pressure difference between the negative pressure and the atmospheric pressure from below, the hammering piston 11 is moved to return to the top dead center as shown in FIG. 1. Moreover, upon separation of the nail driving device from the workpiece, the plate-like part 31 is moved downward by the spring, thus operating the open/close valve 26 in conjunction with this movement and opening the gas pipe 21 to the atmosphere. Since the combustion gas is discharged to the atmosphere from the feed cylinder 7 through the open/close valve 26, the pressure of the feed cylinder 7 is reduced. As shown in FIG. 1, the feed piston 8 is moved in the nail feed direction by the force of the spring 20, and a new leading nail is supplied into the nose part 5. Then, the combustion gas supplied into the feed cylinder 7 can reliably hold the feed piston 8 at the retracted position until the return of the hammering piston 11 is finished and the open/close valve 26 starts an open operation.

It should be noted that the driving tool according to the present embodiment is not limited to a nail driving device. The present invention may be applicable to a driving tool in which power is transmitted by gas combustion, thereby feeding a fastener such as a headed rod member (nail or screw) or a headless rod member (parallel pin) connected thereto.

Although the present invention has been described in detail with reference to particular embodiments, it is apparent to those skilled in the art that various changes and modifications may be made without departing from the spirit and scope of the present invention.

The present application is based on Japanese Patent Application (Japanese Patent Application No. 2007-176033) filed on Jul. 4, 2007, the contents of which are hereby incorporated by reference.

INDUSTRIAL APPLICABILITY

In a gas combustion type driving tool according to the present embodiment, even when a combustion gas is cooled after being supplied into a feed cylinder, the combustion gas is supplied in a high density state, and therefore, the pressure thereof is not reduced much. Thus, a feed piston can be reliably held at a retracted position until the completion of return of a hammering piston. The scrape against a driver at the time of return of the hammering piston is eliminated, and a return failure of the hammering piston and a feed failure of a fastener can be prevented with reliability.

The invention claimed is:

1. A gas combustion type driving tool comprising:

a combustion chamber;

a hammering cylinder;

a hammering piston contained in the hammering cylinder;

a nose part for guiding a driver connected to a lower face side of the hammering piston;

a feed cylinder;

a feed piston contained in the feed cylinder and having a feed claw engaged/disengaged to/from a connecting fastener contained in a magazine;

a gas pipe which is provided between the combustion chamber and the feed cylinder and through which part of a combustion gas is supplied to the feed piston; and a check valve, wherein the feed piston is constantly urged in a fastener feed direction by a spring, wherein upon supply of a combustion gas to the feed cylinder from the gas pipe, the feed piston is operated in a retracting direction against the spring, wherein a combustion gas filter for cooling and increasing the combustion gas in density is provided in the gas pipe so as to supply the combustion gas to the feed cylinder without reducing a pressure of the combustion gas, the combustion gas filter including an upstream filter provided upstream of the check valve; and a downstream filter provided downstream of the check valve, and wherein the feed piston is held at a retracted position by the cooled combustion gas until the completion of return of the hammering piston.

2. The gas combustion type driving tool according to claim 1, wherein the tool comprises an open/close valve in the gas pipe, and wherein the gas pipe is opened to the atmosphere in conjunction with an operation of a movable sleeve following the completion of driving.

3. The gas combustion type driving tool according to claim 1, wherein the gas pipe has an internal diameter sufficiently large to increase the cooling efficiency of the combustion gas filter.

* * * * *